United States Patent [19]

Schauer

[11] 4,362,673

[45] Dec. 7, 1982

[54] MOUNTING A PISTON IN AN ACCELERATOR PUMP OF A CARBURETOR AND ASSOCIATED METHOD

[75] Inventor: Walter Schauer, Neuss, Fed. Rep. of Germany

[73] Assignee: Pierburg GmbH & Co. KG, Fed. Rep. of Germany

[21] Appl. No.: 286,700

[22] Filed: Jul. 24, 1981

[30] Foreign Application Priority Data

Aug. 21, 1980 [DE] Fed. Rep. of Germany ..... 3031546

[51] Int. Cl.[3] ..... F02M 7/08

[52] U.S. Cl. ..... 261/34 A; 417/238

[58] Field of Search ..... 261/34 A; 417/238

[56] References Cited

U.S. PATENT DOCUMENTS

| | | | |
|---|---|---|---|
| 542,766 | 7/1895 | Hultz | 417/238 |
| 1,770,404 | 7/1930 | Holley | 261/34 A |
| 2,035,636 | 3/1936 | Chandler | 261/34 A |
| 2,312,819 | 3/1943 | Heftler | 261/34 A |
| 2,892,622 | 6/1959 | Goodyear | 261/34 R |
| 2,989,227 | 6/1961 | Statham | 417/238 |
| 3,730,495 | 5/1973 | Elam | 261/34 A |
| 4,003,968 | 1/1977 | Rickert | 261/34 R |

FOREIGN PATENT DOCUMENTS

| | | | |
|---|---|---|---|
| 899132 | 12/1953 | Fed. Rep. of Germany | 261/34 A |
| 54-13835 | 2/1979 | Japan | 261/34 A |

*Primary Examiner*—Tim R. Miles

*Attorney, Agent, or Firm*—Posnack, Roberts, Cohen & Spiecens

[57] ABSTRACT

A carburetor comprising an accelerator pump having a working chamber containing fuel and a piston displaceable in the working chamber to discharge fuel therefrom to an inlet passage of the carburetor. A sleeve is secured to the carburetor housing at one end of the working chamber and the piston is slidably guided by the sleeve for movement into and out of the chamber. A sealing ring adjoins the sleeve and includes a free sealing lip directed into the chamber and sealingly bearing against the piston. In order to vary the amount of fuel delivered to the inlet passage for a given stroke of the piston, a piston and sleeve of different diameter are employed while the linkage mechanism between the throttle valve and the piston can remain without change.

13 Claims, 1 Drawing Figure

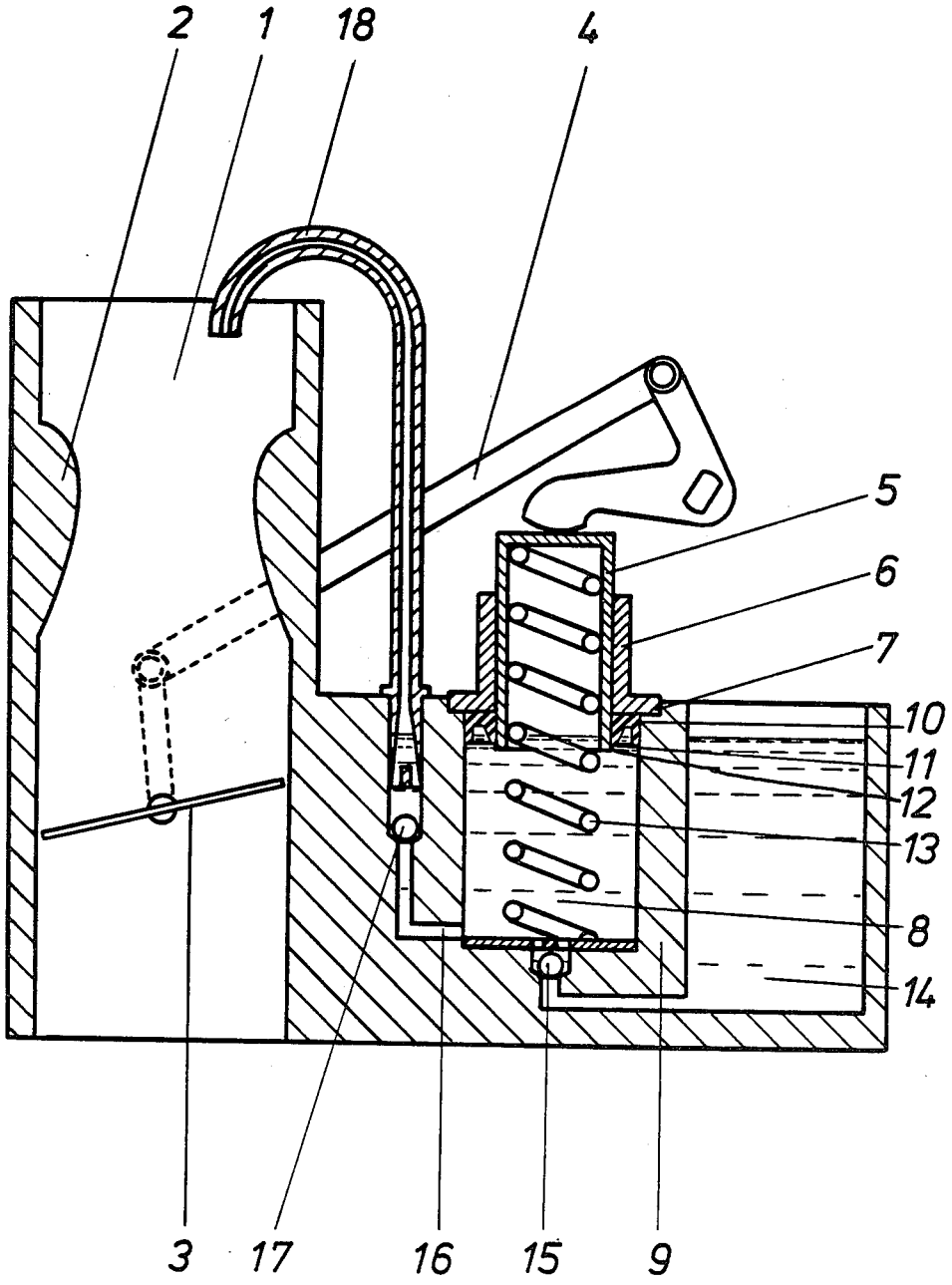
2
1
18
4
5
6
7
10
11
12
13
8
14
3
17
16
15
9

MOUNTING A PISTON IN AN ACCELERATOR PUMP OF A CARBURETOR AND ASSOCIATED METHOD

FIELD OF INVENTION

The present invention relates to a carburetor having an accelerator pump which is actuated as a function of the throttle valve operation and which comprises a working chamber in communication via a non-return valve with the float chamber, a conduit extending via a non-return valve to an injection pipe into the intake passage and a piston in the working chamber which acts against a restoring force.

PRIOR ART

Carburetors having such construction of the accelerator pump are currently available on the market. They have the disadvantage that the working chamber which is contained within the carburetor housing must be machined with high precision at the surface for the guidance of the piston. This, however, is a difficult undertaking, particularly, when the carburetor housing is made from an aluminum die casting.

So-called piston skirts have been proposed but this does not eliminate the machining requirement and expense. In the case of rejection for failure to meet machining standards, high expenses result since the entire housing must be discarded. Furthermore, such pumps have the disadvantage that it is very costly to change the amount of fuel injected, since a different configuration of the rod which actuates the piston is necessary.

SUMMARY OF THE INVENTION

An object of the present invention is to provide a carburetor whose accelerator pump includes elements which are simple to machine and which can be adjusted in simple manner for injection of different amounts of fuel.

This object is achieved in a carburetor of the aforementioned type in that the piston is guided with sliding motion in a sleeve which is mounted at one end of the working chamber in the carburetor housing and a radial sealing ring is arranged below the sleeve, said sealing ring having a free sealing lip directed towards the working chamber and bearing against the cylindrical surface of the piston. Because of the sleeve, it is no longer necessary to machine the working chamber in the housing with great precision since the diameter of the piston can be considerably smaller than the diameter of the working chamber. The piston and sleeve are made of a material which can be easily machined to provide high quality mating surfaces, for example, steel, whereby the cost of production is low. Since the sliding guidance of the piston is effected by the cooperation of the piston and sleeve, simple machining of these parts is readily possible at low cost. A change in the amount of fuel injected for a constant diameter of the working chamber can be effected by using a different piston with a smaller or larger diameter, the inside diameter of the sleeve being adapted accordingly. It then is merely necessary to use a different radial sealing ring having a diameter correlated to the new diameter of the piston.

BRIEF DESCRIPTION OF THE DRAWING

One illustrative embodiment of the invention is shown diagrammatically in transverse section in the sole FIGURE of the drawing.

DETAILED DESCRIPTION

The drawing illustrates only those parts of a carburetor necessary for an understanding of the invention and description will be made only of the illustrated parts.

The carburetor has an intake passage 1 containing a Venturi 2 and a throttle valve 3 downstream of the Venturi 2. The throttle valve 3 is controlled by the operator of the vehicle as desired. The shaft of the throttle valve 3 acts via a rod 4 on a piston 5 of an accelerator pump to supply fuel to the intake passage 1 during acceleration of the vehicle. The piston 5 is slidably guided within a sleeve 6. The sleeve 6 has a flange or neck 7 by which the sleeve is fastened at one end of a working chamber 8 in carburetor housing 9. The housing 9 has a recess therein to receive the flange 7. The main body of sleeve 6 projects above the housing 9. Within the working chamber 8 of the carburetor housing there is also provided a radial sealing ring 10 having a free sealing lip 11 directed into the working chamber 8 and which bears in sealing fashion against the cylindrical outer surface 12 of the piston. The piston 5 acts against a compression spring 13 disposed within the working chamber 8. The working chamber is filled with fuel from a float chamber 14 via a non-return valve 15. During a working stroke of the piston 5, fuel is discharged from the working chamber via a conduit 16 and a non-return valve 17 and is fed to an injection pipe 18 which opens into the intake passage 1 upstream of the Venturi 2.

The inner surface of sleeve 6 guides the outer surface of piston 5 and these surfaces are accurately machined to provide a smooth interfitting relation. The sleeve and piston are made from easily machinable material, such as steel, to facilitate precision machining with close tolerances.

If it is desired to adjust the amount of fuel discharged from injection pipe 18 for a given working stroke of piston 5, it is only necessary to replace the unit consisting of sleeve 6, piston 5, and sealing ring 10 with a unit whose sleeve and piston have mating surfaces which are of larger or smaller diameter as desired. The new sealing ring 10 will have an inner diameter which conforms to that of piston 5 so that lip 11 tightly engages surface 12 of the piston in sealing relation while the ring also will tightly engage the wall surface of the working chamber 8 and the abutment face of flange 7.

In order to replace one unit with another, it is merely necessary to remove the existing unit consisting of sleeve 6, piston 5 and sealing ring 10 and then insert the new unit into housing 9. The ring 10 will be slightly compressed when the unit is inserted into the housing and the lip 11 will bear tightly against the piston 5. The U-shaped cross section of the sealing ring 10 facilitates this operation. The unit will be inserted into the housing 9 until the flange 7 is fully seated in the recess of the housing and the flange 7 will be secured in place in any suitable fashion such as by fasteners, adhesives, press fit or the like.

As evident from the above, the outside dimensions of the sleeve and the sealing ring remain constant for each unit and it is only the outer diameter of the piston, the inner diameter of the sleeve and the inner diameter of the sealing ring which vary. Additionally, while reference has been made to replacement of one unit with another, it will be clear that initial installation of a unit will be the same as the installation of a replacement unit as described above.

All the invention has been described in conjunction with a specific embodiment thereof, it will become apparent to those skilled in the art, that numerous modifications and variations can be made within the scope and spirit of the invention as defined by the attached claims.

What is claimed is:

1. In a carburetor having a housing with an inlet passage and an accelerator pump including a working chamber containing fuel, a piston displaceable in said working chamber to discharge fuel therefrom, and a conduit connected to the working chamber for conveying the discharged fuel to said inlet passage, the improvement comprising a sleeve secured to said housing at one end of said working chamber, said piston being slidably guided by said sleeve for movement into and out of said chamber, and a sealing ring adjoining said sleeve and including a free sealing lip directed into said chamber and sealingly bearing against said piston.

2. The improvement as claimed in claim 1 wherein said sleeve includes a radial flange secured to said housing.

3. The improvement as claimed in claim 2 wherein said sleeve includes a cylindrical body portion extending from said flange outside said housing.

4. The improvement as claimed in claim 3 wherein said radial flange is seated in an annular recess provided in said housing.

5. The improvement as claimed in claim 1 wherein said sleeve, piston and sealing ring constitute a unit assemblable as such in said housing.

6. The improvement as claimed in claim 1 wherein said sealing ring has a U-shaped cross section.

7. The improvement as claimed in claim 6 wherein said sealing ring has an outer surface bearing against said housing in said working chamber, and an end surface bearing against said sleeve.

8. A unit assemblable in a working chamber in a housing of an acceleration pump of a carburetor, said unit comprising a sleeve adapted for being secured to the housing at one end of the working chamber, a piston slidably guided by said sleeve for axial movement therein such that with the sleeve secured to the housing the piston is movable into and out of the working chamber, and sealing means for sealing the unit in the working chamber and providing a seal between the piston and the sleeve.

9. A unit as claimed in claim 8 wherein said sealing means comprises a sealing ring adjoining said sleeve and including a lip directed away from said sleeve and sealingly bearing against said piston.

10. A unit as claimed in claim 9 wherein said sleeve includes a radial flange thereon which said sealing ring adjoins.

11. A unit as claimed in claim 10 wherein said sealing ring is U-shaped in cross section.

12. A method of controlling the amount of fuel discharged by an accelerator pump of a carburetor comprising displacing a piston in a working chamber of an accelerator pump to discharge fuel from the working chamber into an intake passage of the carburetor, the piston being part of a replaceable unit and having a diameter corresponding to a particular amount of fuel to be discharged for a given stroke for the piston, said unit being sealably mounted in the working chamber to provide a desired amount of fuel to be discharged, and removing said unit from the working chamber and inserting another with a different piston diameter into the working chamber to change the amount of fuel discharged from the accelerator pump to the intake passage of the carburetor.

13. A method as claimed in claim 12 wherein said units are formed with the same outside dimensions so that mounting of the units in the working chamber is the same for both units.

* * * * *